US006866018B2

(12) United States Patent
Kaiser et al.

(10) Patent No.: US 6,866,018 B2
(45) Date of Patent: Mar. 15, 2005

(54) ELECTRIC-MOTOR ADJUSTING UNIT FOR A METERING SYSTEM OF AN INTERNAL COMBUSTION ENGINE

(75) Inventors: Klaus Kaiser, Markgroeningen (DE); Michael Brozio, Korntal-Muenchingen (DE); Markus Michels, Stuttgart (DE); Stefan Josten, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/276,268

(22) PCT Filed: Mar. 13, 2002

(86) PCT No.: PCT/DE02/00893

§ 371 (c)(1),
(2), (4) Date: Jun. 13, 2003

(87) PCT Pub. No.: WO02/075135

PCT Pub. Date: Sep. 26, 2002

(65) Prior Publication Data

US 2004/0079331 A1 Apr. 29, 2004

(30) Foreign Application Priority Data

Mar. 15, 2001 (DE) ..... 101 12 427

(51) Int. Cl.[7] ..... F02D 9/10
(52) U.S. Cl. ..... 123/337; 123/399
(58) Field of Search ..... 123/361, 399, 123/337

(56) References Cited

U.S. PATENT DOCUMENTS 4,688,420 A * 8/1987 Minagawa ..... 73/118.1
6,067,958 A * 5/2000 Kamimura et al. ..... 123/399
6,347,613 B1 * 2/2002 Rauch ..... 123/399
6,478,012 B2 * 11/2002 Bender ..... 123/361
6,691,678 B1 * 2/2004 Hashimoto et al. ..... 123/399
2002/0104511 A1 * 8/2002 Torii et al. ..... 123/399
2003/0024505 A1 * 2/2003 Anschicks et al. ..... 123/399

FOREIGN PATENT DOCUMENTS

DE 196 44 169 * 4/1998
EP 0 569 392 * 5/1994
JP 10 176553 * 6/1998

* cited by examiner

*Primary Examiner*—Erick Solis
(74) *Attorney, Agent, or Firm*—Ronald E. Greigg

(57) ABSTRACT

An electric-motor adjusting unit for a metering system of an internal combustion engine, having an adjuster housing and an adjusting shaft rotatable therein that actuates a final control element, having a commutator motor coupled to the adjusting shaft, having a sensor for detecting the rotary position of the adjusting shaft, and having a carrier plate that can be secured in the adjuster housing, on which plate on the one hand a brush holder for the commutator motor and on the other a plug electrically connected to the brush holder and to the sensor are disposed, in order to obtain a prefabricatable assembly unit with which installation tolerances in the adjuster housing can be compensated for, the sensor being disposed on a carrier, and on the carrier and on the carrier plate, joining means corresponding with one another for joining the carrier and the carrier plate are embodied.

22 Claims, 3 Drawing Sheets

ELECTRIC-MOTOR ADJUSTING UNIT FOR A METERING SYSTEM OF AN INTERNAL COMBUSTION ENGINE

CROSS-REFERENCE TO RELATED APPLICATIONS

This application is a 35 USC 371 application of PCT/DE 02/00893 filed on Mar. 13, 2002.

BACKGROUND OF THE INVENTION

1. Field of the Invention

The invention is directed to an improved electric-motor adjusting unit for a metering system of an internal combustion engine, such as an air or fuel metering system.

2. Description of the Prior Art

One known electric-motor adjusting unit of this type (German Patent Disclosure DE 196 44 169 A1) is embodied as a throttle valve adjusting unit, in which the final control element is a throttle valve, which in an air intake system of the engine, by more or less widely opening the cross section of a throttle valve stub, controls the quantity of air delivered to the engine. In this throttle valve adjusting device, the carrier plate holds not only the plug and the brush holder but also the sensor, embodied as a potentiometer, for reporting the throttle valve position; this sensor is connected to plug contacts of the plug via electrically conductive, rigid baffles placed in the printed circuit board. The carrier plate, fully preassembled with the plug, brush holder and sensor, is inserted into the housing, whereupon the commutator brushes slip onto the commutator of the commutator motor, and the rotatable part of the potentiometer couples to the adjusting shaft or throttle valve shaft. The carrier plate used is positionally fixed in the housing by means of screws and is thus connected to the throttle valve housing in a way that is shake-proof.

SUMMARY OF THE INVENTION

The electric-motor adjusting unit of the invention has the advantage that as a result of the joining of the carrier plate, which carries the plug and brush holder, and the carrier that carries the sensor for detecting the final control element position, a prefabricated assembly unit is created, in which all the electrical connections among the components are present. Since the carrier plate and the carrier are not rigidly connected but instead are only joined, installation tolerances can be easily compensated for when the assembly unit is installed in the adjuster housing, making the installation process quite easy to automate. Once the assembly unit is secured in the adjuster housing, a fixed mechanical connection can also be created between the carrier and the carrier plate by means of additionally soldering the electrical conductors, contacting one another at the joining point, of the carrier and of the carrier plate.

The two-part nature of the joined assembly unit comprising the carrier and the carrier plate has the additional advantage also that the unaltered assembly unit can be used for adjusting units of various designs of the gear that is typically present between the commutator motor and the adjusting shaft. The spacings, which vary in various variant gears, of the axes, oriented parallel to one another, of the adjusting shaft and the motor shaft of the commutator motor, and the housing size that also varies with the variation and gear, can be taken into account by providing that the joining means are placed against one another with corresponding displacement, so that the relative position of the carrier plate and the carrier adapts to the existing installation space in the adjuster housing. Thus for various gear designs, many fewer different forms of carrier and carrier plate have to be kept on hand, which has marked cost advantages.

In one advantageous embodiment of the invention, the joining means have a slide tongue and a tongue guide that receives the slide tongue, of which one is disposed on the carrier plate, and the other is disposed on the carrier. The tongue guide is preferably composed of two parallel, spaced-apart longitudinal struts, which are connected on their underside via a transverse strut. Because of this structural embodiment, the carrier and the carrier plate can be varied continuously in their relative position and thus adapted highly precisely to given installation conditions in the adjuster housing.

In an alternative embodiment of the invention, the joining means have electrically conductive pins, and the pins in the joining point have electrically conductive eyelets surrounding them with play. The pins are embodied on the electrical conductors of the carrier plate, and the eyelets are embodied on the electrical conductors of the carrier, or vice versa. If the electrical conductors of the carrier plate are embodied as a stamped grid, the pins on the end of the stamped grid are preferably bent integrally from it at a right angle, and if the electrical conductors of the carrier are embodied as conductor tracks of a printed circuit board, the eyelets are each made in the form of holes in one of the printed circuit boards. The joining of the carrier and carrier plate is then accomplished by inserting the pins into the eyelets of the printed circuit board; because of the existing play, a certain tolerance compensation in the relative position of the carrier and the carrier plate is possible. Upon insertion of the pins into the eyelets, the electrical contacting is simultaneously made, and this can be assured by means of additional bonding or soldering. Thus simultaneously a mechanically rigid connection between the carrier and the carrier plate is also created.

In this alternative embodiment, the variance in the relative position of the carrier and the carrier plate is achieved by providing that, in an advantageous embodiment of the invention, the eyelets are disposed, spaced apart from one another, in a row extending transversely to the joining direction, and that at least one identically embodied second row of further eyelets is disposed parallel to the first row of eyelets. Depending on the design of the gear and the associated size of the adjuster housing, the pins can be inserted into the first row of eyelets or into successive rows of eyelets, and as a result, the relative position of the carrier and the carrier plate can be adapted to the housing size.

It is understood that it is also possible for the joining means embodied on the carrier and the carrier plate may instead have a slider tongue and a tongue guide, rather than pins and eyelets insertable into one another on the carrier and the carrier plate.

BRIEF DESCRIPTION OF THE DRAWINGS

The invention is explained in further detail in the ensuing description, in terms of exemplary embodiments shown in the drawings, in which.

DESCRIPTION OF THE PREFERRED EMBODIMENTS

Figure 1:
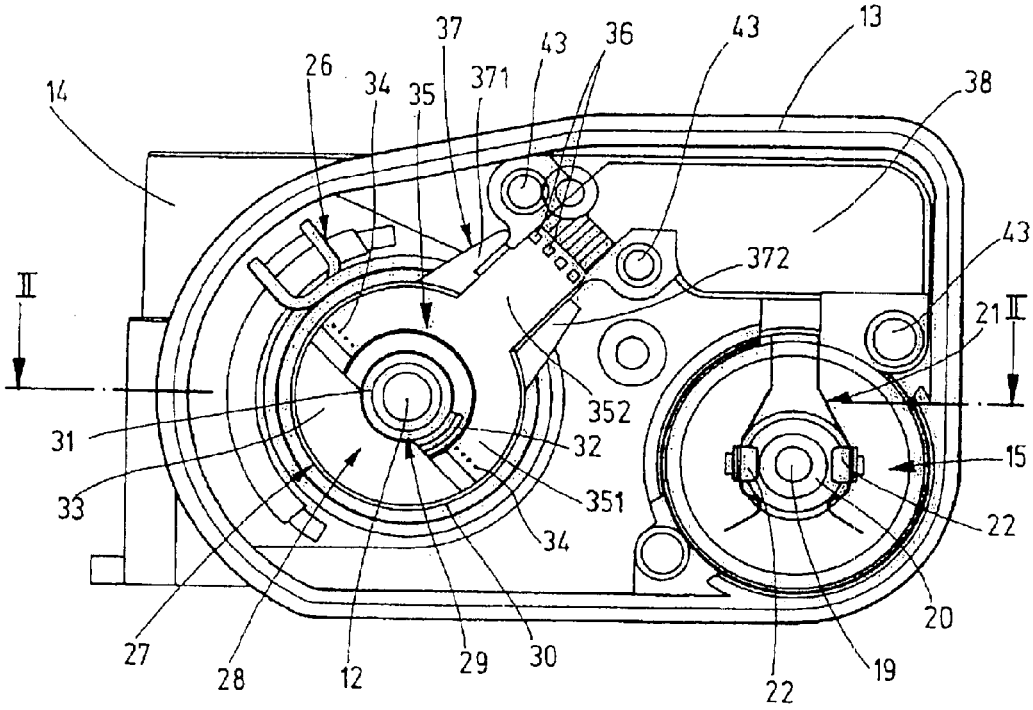
FIG. 1, a view of an adjusting unit in the direction of arrow I in FIG. 2, with the gear removed.
Figure 2:
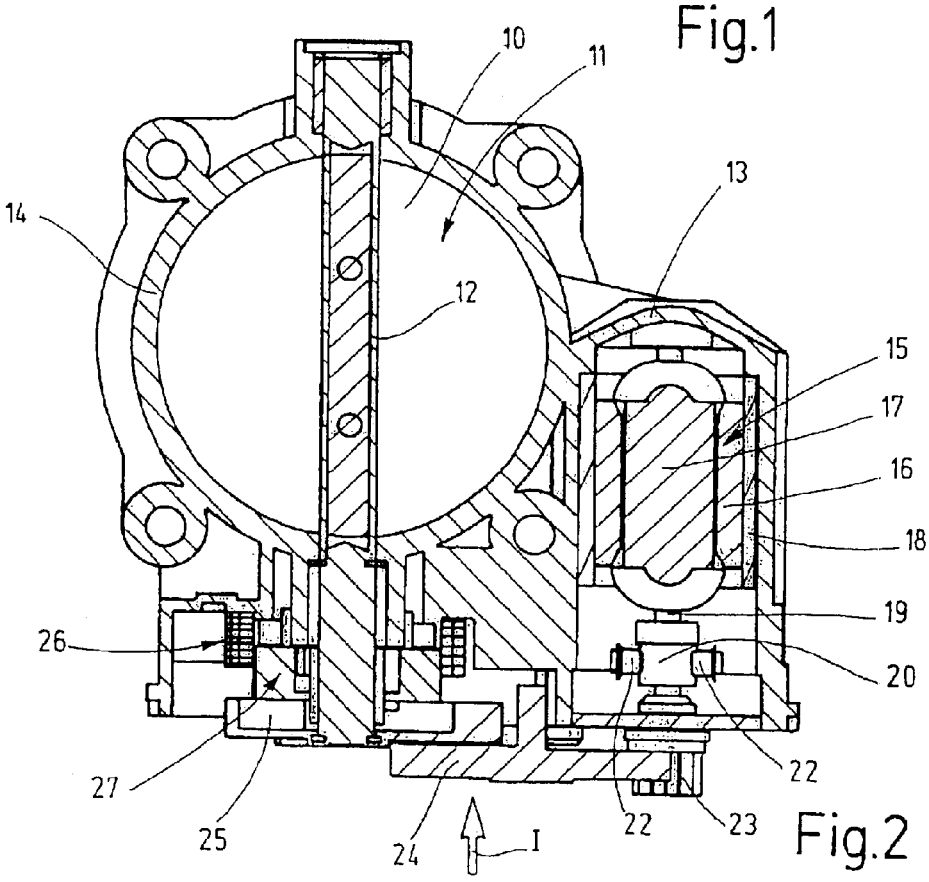
FIG. 2, a section taken along the line II—II in FIG. 1.

The electric-motor adjusting unit, shown in FIGS. 1 and 2, for metering systems in internal combustion engines serves as a so-called throttle valve adjusting unit to control the combustion air aspirated by the engine. To that end, it has a final control element 11, embodied as a throttle valve 10, which is seated in a manner fixed against relative rotation on an adjusting shaft 12 that in turn is rotatably supported in an adjuster housing 13. The throttle valve 10 is disposed in a throttle valve stub 14, and depending on its rotary position it uncovers a more or less large inside cross section of the throttle valve stub 14. The throttle valve stub 14 is disposed in an air intake tube that leads to the engine.

For rotating the adjusting shaft 12, a commutator motor 15 embodied here as a direct-current motor is used; it is received as a complete unit, comprising the motor housing 18, stator 16, and rotor 17, in the adjuster housing 13 (FIG. 2). A commutator 20 is seated in a manner fixed against relative rotation on a motor shaft 19 that carries the rotor 17, and two carbon or commutator brushes 22 press diametrically against the commutator. Also seated on the motor shaft 19 is a drive pinion 23, which via a step-up gear 24 drives a gear segment 25 disposed in a manner fixed against relative rotation on the adjusting shaft 12. The adjustment of the adjusting shaft 12 via the gear segment 25 is effected counter to a restoring device 26, which by means of a prestressed spring, when the commutator motor 15 is currentless, returns the throttle valve 10 to a so-called emergency-air position, in which only a quantity of air sufficient for emergency operation of the engine is aspirated via the throttle valve stub 14. The emergency-air position of the throttle valve 10 is shown in FIG. 2. The emergency-air quantity is defined by the air passage cross section uncovered on the left-hand edge, in FIG. 2, of the throttle valve 10, between the throttle valve and the throttle valve stub 14.

Coupled to the adjusting shaft 12 is a sensor 27, which detects the rotary position of the adjusting shaft 12 and sends it as an electrical signal to a control unit. The sensor 27 comprises a sensor stator 28, which is fixed to a carrier 30 and surrounds the adjusting shaft 12 with radial spacing, and a sensor rotor 29, surrounded by the sensor stator 28, that is coupled to the adjusting shaft 12 in a manner fixed against relative rotation. The sensor rotor 29 comprises a sleeve 31, seated in a manner fixed against relative rotation on the adjusting shaft 12, and a magnet 32, secured to the sleeve 31 and protruding radially from it, that is capable of rotating in the space between the sleeve 31 and the sensor stator 28. The sensor stator 28 is put together from two half-ring flux concentrating pieces 33 to make one complete ring, and it has two diametrically disposed Hall ICs 34, which are disposed on a printed circuit board 35. The printed circuit board 35 has one half-ring-shaped printed circuit board part 351 and one strutlike printed circuit board part 352 that is integral with it and extends it radially at the middle. The half-ring-shaped printed circuit board part 351 rests on the one half-ring-shaped flux concentrating piece 33 and carries the two Hall ICs 34 on its free ends. The strutlike printed circuit board part 352, on its free end, has four freely accessible contact points 36, which are each put in contact with the Hall ICs 34 via conductor tracks, not shown here, of the printed circuit board 35. The carrier 30 for the sensor 27, which is embodied in sleevelike fashion and because of its cylindrical structure simultaneously serves as a guide for the restoring device 26, has a tongue guide 37, projecting radially from it, that comprises two parallel, spaced-apart longitudinal struts 371 and 372. The two longitudinal struts 371 and 372 are connected to one another on their free ends via a transverse strut 373, which extends along the underside of the longitudinal struts 371, 372. Once the printed circuit board 35 has been installed, the strutlike printed circuit board part 352 rests on the top side of the longitudinal struts 371, 372 and extends closely above the tongue guide 37. The tongue guide 37 is a joining means for attaching the carrier 30 to a carrier plate 38 and for making an electrical contact of the sensor 27 with plug contacts of a plug 39 that is disposed on the carrier plate 38. Via these plug contacts, not shown here, of the plug 39, the sensor 27 is connected to the control unit.

Figure 4:
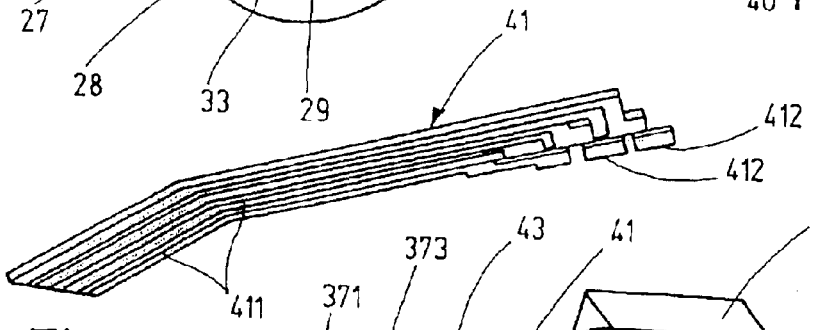
FIG. 4, a perspective view of a stamped grid integrated with the carrier plate of FIG. 3.

In addition to the plug 39, the brush holder 21 is also secured to the carrier plate 38. In the exemplary embodiment shown, the brush holder 21 is embodied as a so-called hammer brush holder, which has two freely cantilevered, current-carrying leaf springs 40, each carrying one commutator brush 22, which are inserted by one end into the carrier plate 38 and are connected to electrical conductors that lead to plug contacts of the plug 39. All the electrical conductors on the carrier plate 38 are embodied by a stamped grid 41 (FIG. 4). The stamped grid 41, which here comprises six separate electrical conductor tracks 411, 412, is either injected into the carrier plate 38, or is set in a prepared recess in the carrier plate 38. All the conductor tracks 411, 412 are contacted on one end to one of the plug contacts of the plug 39. Two conductor tracks 412 are contacted with the leaf springs 40 of the brush holder 21 and serve to supply current to the rotor 17. Four conductor tracks 411 extend, with bent conductor track portions, across a slide tongue 42 embodied integrally with the carrier plate 38, and on their top side they are located in the open, once the stamped grid 41 has been injected into the carrier plate 38. The slide tongue 42, also representing a joining means, is adapted to the tongue guide 37 on the carrier 30 and upon the joining of the carrier and carrier plate 38, the slide tongue slips between the longitudinal struts 371 and 372 of the tongue guide 37. Simultaneously, the conductor tracks that carry the contact points 36 in the strutlike printed circuit board part 352 slip onto the end portions, located in the open on the slide tongue 42, of the conductor tracks 411 of the stamped grid 41, so that the electrical connection is made between the sensor 27 and the plug 39.

Once the carrier 30 and the carrier plate 38 are joined, a prefabricated assembly unit is created, in which the components comprising the sensor 27 and the brush holder 21 are functionally connected to the plug 39 and need merely then be inserted into the adjuster housing 13 and fixed. Upon insertion of the assembly unit, the commutator brushes 22 slip onto the commutator 20 of the commutator motor 15 that has already been inserted into the adjuster housing 13, and the sleeve 31 of the sensor 27 surrounds a portion of the adjusting shaft 12. In the carrier plate 38, fastening holes 43 are provided, through which fastening screws can be passed that can be screwed into threaded holes, congruent with the fastening holes 43, in the adjuster housing 13. Upon installation of the assembly unit, installation tolerances can be compensated for by the displacement of the slide tongue 42 in the tongue guide 37. Once installation has been accomplished, the conductor tracks of the printed circuit board 35 can be welded or bonded, at the contact points 36 of the printed circuit board 35, to the end portions, located positionally correctly under them, of the conductor tracks 411 of the stamped grid 41, thus establishing a shake-proof and vibration-proof electrical and mechanical connection between the carrier 30 and the carrier plate 38. Given a suitable embodiment, the slide tongue 42 on the carrier plate 38 can be used for mechanically fixing the carrier 30 and the carrier plate 38, in that when the carrier plate 38 is tightened in the adjuster housing 13 by means of the fastening screws passed through the fastening holes 43, the slide tongue presses the transverse strut 373 of the tongue guide 37 onto the adjuster housing 13 and thus establishes a clamping connection between the carrier 30 and the carrier plate 38. In assembly, it is also possible first to slip the assembly unit, comprising the carrier 30 and carrier plate 38, onto the commutator motor 15, and then to insert them both into the adjuster housing 13.

Figure 3:
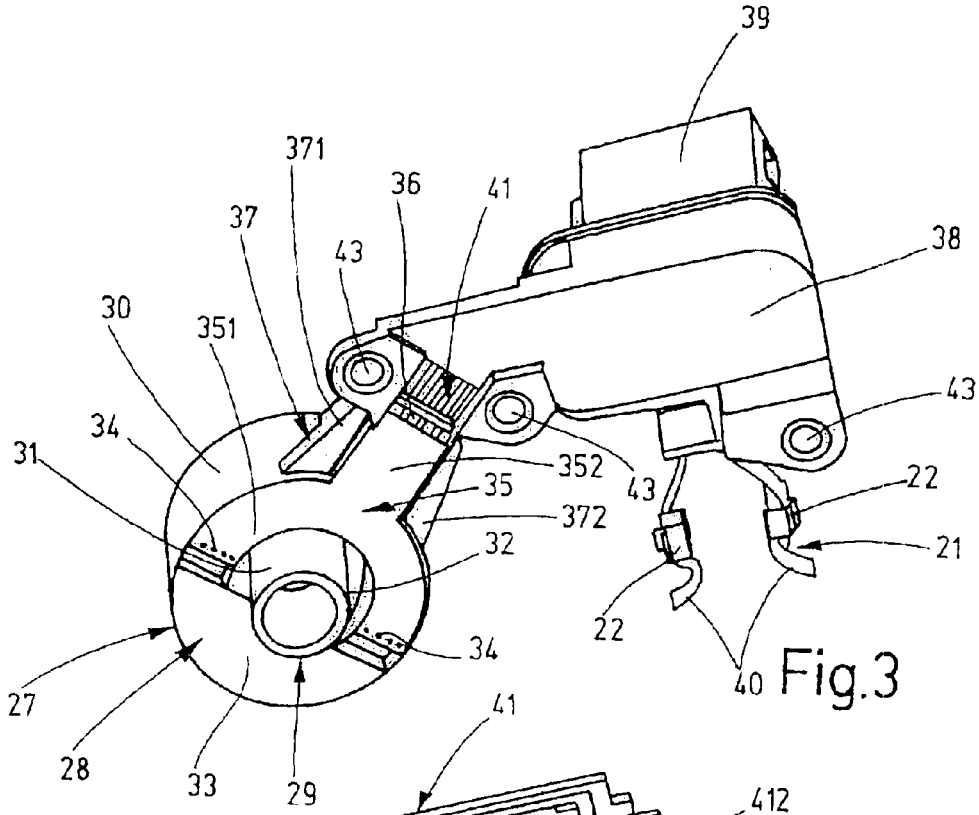
FIG. 3, a perspective view of an assembly unit, comprising a carrier and a carrier plate, in the adjusting unit of FIGS. 1 and 2.
Figure 5:
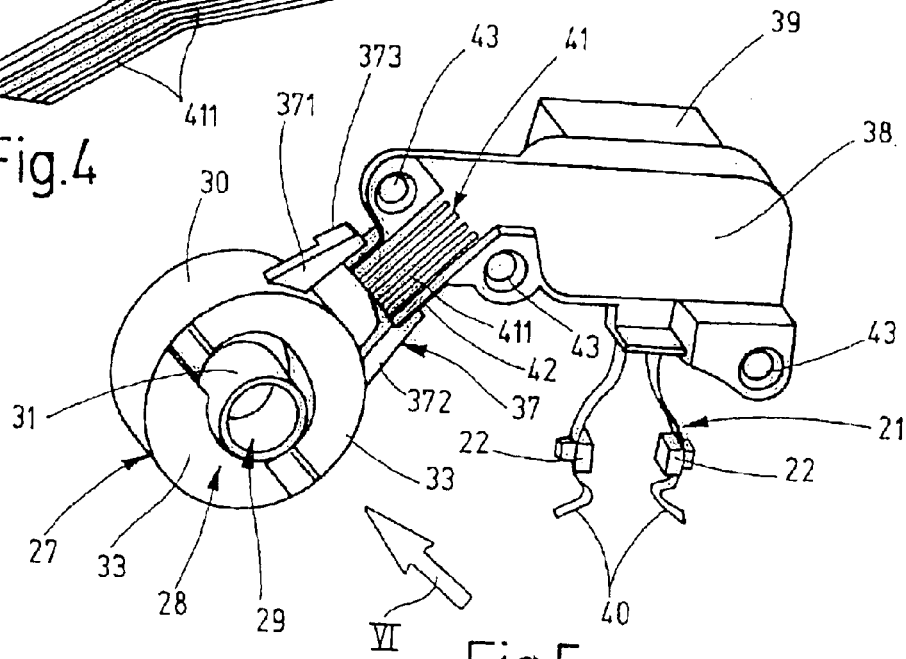
FIG. 5, an identical view to FIG. 3, with the printed circuit board removed from the carrier.
Figure 6:
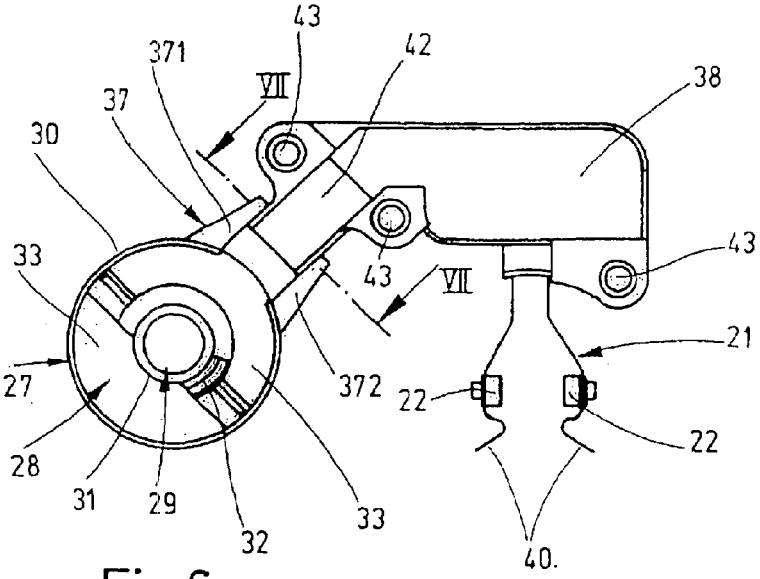
FIG. 6, a plan view taken in the direction VI in FIG. 5.
Figure 7:
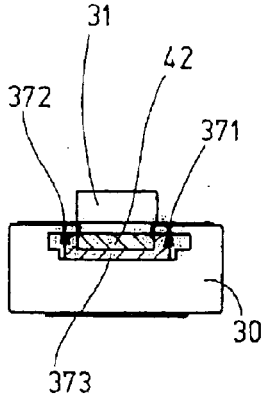
FIG. 7, a section taken along the line VII—VII in FIG. 6.

The electric-motor adjusting unit described, embodied as a throttle valve adjusting unit, is shown in complete form in section in FIG. 2 and in FIG. 1 in a view in the direction of the arrow I in FIG. 2; in FIG. 1, the drive pinion 23 has been removed from the motor shaft 19, and the gear segment 25 has been removed from the adjusting shaft 12, and the step-up gear 24 has also been removed. The complete assembly unit, joined together from the carrier 30 and carrier plate 38, including the sensor 27, brush holder 21 and plug 39, is shown in FIG. 3 before installation in the adjuster housing 13. In FIG. 5, for this assembly unit, the printed circuit board 35 has been removed from the carrier 30 for the sensor 27, in order to show clearly the joining point between the carrier 30 and carrier plate 38 and the joining means, embodied as a tongue guide 37 and slide tongue 42, on the carrier 30 and carrier plate 38. FIG. 6 shows a plan view on the assembly unit of FIG. 5 and a sectional course through the joining point. This section through the joining point shown in FIG. 7 shows the longitudinal struts 371, 372 of the tongue guide 37, which protrude from the sleevelike carrier 30 and on their free end have the transverse strut 373 fitting over them on the underside, and also shows the slide tongue 42 on the carrier plate 38, which tongue is received between the longitudinal struts 371, 372 and is located above the transverse strut 373.

Figure 8:
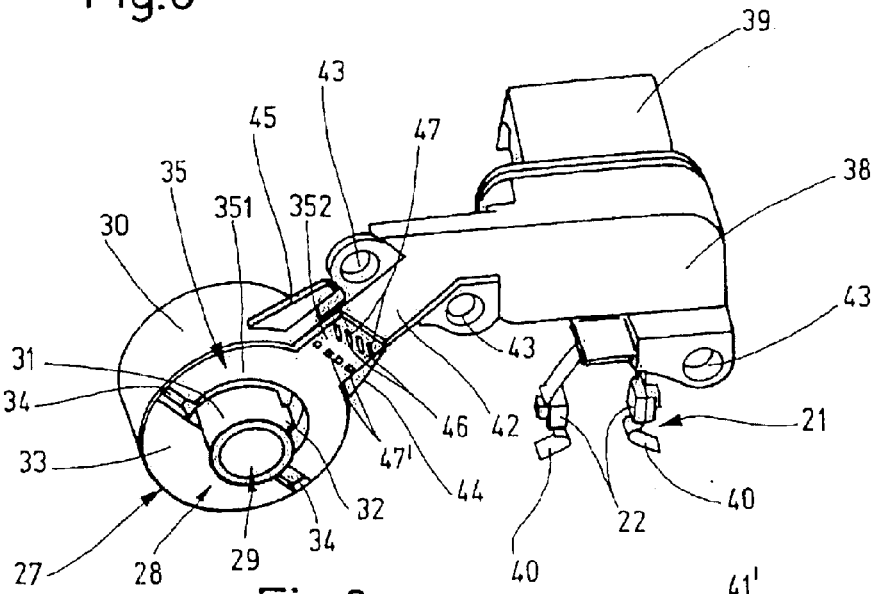
FIG. 8, an identical view to FIG. 3, of a modified assembly unit.
Figure 9:
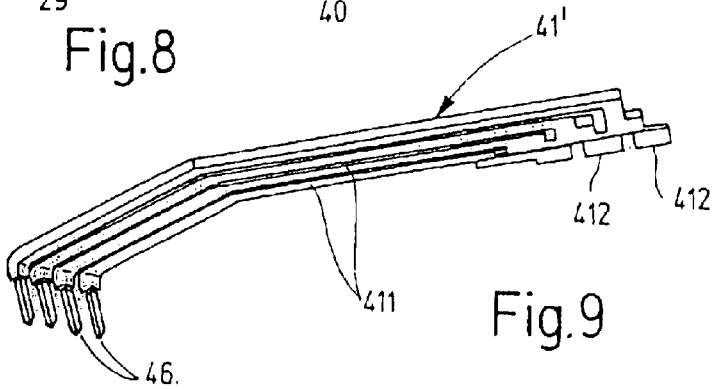
FIG. 9, a perspective view of a stamped grid in the carrier plate of FIG. 8.

The modified assembly unit, shown in FIG. 8, comprising the carrier 30 and carrier plate 38 is insertable in the same way into the adjuster housing 13 of the adjusting unit. This largely agrees with the assembly unit described above, and thus identical components are provided with the same reference numerals, and the only modification is in terms of the joining means for putting together the carrier 30 and carrier plate 38. The longitudinal struts 44 and 45, which are also present on the carrier 30 but are modified here, have no guide function for the slide tongue 42 on the unchanged carrier plate 38. They serve solely to provide the correct orientation of the carrier 30 upon being attached to the carrier plate 38. The stamped grid 41' integrated with the carrier plate 38 has been modified to the extent that the four conductor tracks 411, on their end resting on the slide tongue 42, carry pins 46 oriented perpendicularly upward, which protrude at right angles from the carrier plate 38 (FIG. 9). The pins 46 here are disposed, spaced apart from one another, in a row oriented transversely to the longitudinal axis of the slide tongue 42. Except for the protruding pins 46, the stamped grid 41' is injected in complete form into the carrier plate 38.

The printed circuit board 35 affixed to the carrier 30, on the free end of its strutlike printed circuit board part 352, has a plurality of eyelets 47, which correspond in number to the number of pins 46 on the stamped grid 41'. Although not shown, the eyelets 47 are formed by a hole, each in one of the conductor tracks of the printed circuit board 35. Like the pins 46, the eyelets 47 are disposed in a row, side by side and spaced apart from one another; the row extends perpendicular to the longitudinal axis of the strutlike printed circuit board part 352. Upon the joining of the carrier 30 and the carrier plate 38, the eyelets 47 are slipped over the pins 46. The inside diameter of the eyelets 47 is selected to be somewhat greater than the outside diameter of the pins 46, so that the play existing between the pins 46 and eyelets 47 assures a limited capability of motion between the carrier 30 and the carrier plate 38, and as a result any incident tolerances upon installation of the assembly unit in the adjuster housing 13 can be compensated for. Once the carrier plate 38 has been fixed by means of the fastening holes 43 in the adjuster housing 13, the pins 46 are soldered, for instance, to the eyelets 47, so that a shake-proof and vibration-proof mechanical and electrical connection is made between the carrier 30 and the carrier plate 38. Here as well, the Hall ICs 34 are electrically connected to plug contacts in the plug 39 via the conductor tracks in the printed circuit board 35, the eyelets 47 and pins 46, and the conductor tracks 411 of the stamped grid 41'. The two commutator brushes 22 are connected to two further plug contacts of the plug 39 via the leaf springs 40 and two further conductor tracks 412 of the stamped grid 41'. Via the plug 39, on the one hand the sensor 27 for reporting the rotary angle position of the adjusting shaft 12 is connected to the control unit, and on the other, the commutator motor 15 is connected to the direct-voltage source.

To make the assembly unit comprising the carrier 30 and carrier plate 38 compatible for other sizes of adjuster housing 13, with different spacings between the adjusting shaft 12 and the motor shaft 19, there is at least one further row of eyelets 47' in the strutlike printed circuit board part 352, and this row is disposed parallel to and axially spaced apart from the first row of eyelets 47. These eyelets 47', like the eyelets 47, are embodied by holes in the conductor tracks of the printed circuit board 35. Upon joining, the pins 46 protruding from the slide tongue 42 of the carrier plate 38 can now be inserted selectively into the frontmost row of eyelets 47 or into the back row of eyelets 47', as a result of which the spacing between the carrier 30 and the carrier plate 38 changes.

The invention is not limited to the above-described example of a throttle valve adjusting unit. For instance, the final control element of the electric-motor adjusting unit described can also be a control flap, which is disposed in an exhaust gas recirculation line of an internal combustion engine and which meters a quantity of exhaust gas that is delivered to the combustion air of the engine. Instead of the sensor 27 equipped with a Hall IC, a known sensor embodied as a potentiometer can also detect the rotary position of the adjusting shaft 12.

What is claimed is:

1. An electric-motor adjusting unit for a metering system of an internal combustion engine, comprising, a final control element (11), an adjuster housing (13) having an adjusting shaft (12) rotatably mounted therein that actuates the final control element (11), a commutator motor (15), coupled to the adjusting shaft (12), for rotating the adjusting shaft (12), the motor having a commutator (20), seated on a motor shaft (19) in a manner fixed against relative rotation, and commutator brushes (22) that press onto the commutator (20), a sensor (27) for detecting the rotary position of the adjusting shaft (12), a carrier plate (38) adapted to be secured in the adjuster housing (13) and having thereon on the one hand a brush holder (21) that holds the commutator brushes (22) and on the other a plug (39) electrically connected to the brush holder (21) and to the sensor (27), the sensor (27) being disposed on a carrier (30), and joining means on the carrier (30) and on the carrier plate (38), the joining means corresponding with one another and cooperating to join the carrier (30) and the carrier plate (38).

2. The adjusting unit of claim 1, wherein the joining means are embodied such that the carrier (30) and the carrier plate (38) can be placed against one another in different relative positions.

3. The adjusting unit of claim 1, wherein the joining means are embodied such that at the joining point, they enable a relative displacement between the carrier (30) and the carrier plate (38).

4. The adjusting unit of claim 2, wherein the joining means are embodied such that at the joining point, they enable a relative displacement between the carrier (30) and the carrier plate (38).

5. The adjusting unit of claim 1, further comprising electrical conductors disposed on the carrier (30) leading to the sensor (27), and electrical conductors leading to the plug (39) disposed on the carrier plate (38), both in such a way that they contact one another in the region of the joining point of the carrier (30) and carrier plate (38).

6. The adjusting unit of claim 5, wherein the electrical conductors in the carrier plate (38) comprise a stamped grid (41; 41').

7. The adjusting unit of claim 5, wherein the electrical conductors in the carrier (30) are formed by conductor tracks of a printed circuit board (35).

8. The adjusting unit of claim 7, wherein the printed circuit board (35) has a half-ring-shaped printed circuit board part (351) and a strutlike printed circuit board part (352) projecting radially from it.

9. The adjusting unit of claim 1, wherein the joining means comprise a slide tongue (42) and a tongue guide (37) that receives the slide tongue (42), one of which is disposed on the carrier plate (38), and the other of which is disposed on the carrier (30).

10. The adjusting unit of claim 8, wherein the carrier (30) is embodied in sleevelike fashion, and the tongue guide (37) protrudes radially from the carrier (30).

11. The adjusting unit of claim 9, wherein the tongue guide (37) has two parallel longitudinal struts (371, 372), spaced apart from one another, and a transverse strut (373) joining the longitudinal struts (371, 372) to one another.

12. The adjusting unit of claim 11, wherein the transverse strut (373) is disposed on the underside of the free end, remote from the carrier (30), of the longitudinal struts (371, 372).

13. The adjusting unit of claim 10, wherein the half-ring-shaped printed circuit board part (351) of the printed circuit board (35) rests by positive engagement in the carrier (30), and the strutlike printed circuit board part (352) extends along the tongue guide (37).

14. The adjusting unit of claim 13, wherein on the end of the conductor tracks in the printed circuit board (35) located in the strutlike printed circuit board part (352), one freely accessible contact point (36) each is provided for connecting the conductor tracks to the stamped grid (41) disposed in the carrier plate (38).

15. The adjusting unit of claim 5, wherein the joining means comprise electrically conductive pins (46) and electrically conductive eyelets (47) which surround the pins (46) with play in the joining point, one category of which eyelets (47) or pins (46) being embodied on the electrical conductors in the carrier plate (38), and the other category of which being embodied on the electrical conductors in the carrier (30).

16. The adjusting unit of claim 15, wherein the pins (46) protrude perpendicularly from the carrier plate (38), and the eyelets (47) are each made in the form of holes into a conductor track of the printed circuit board (35) on the carrier (30).

17. The adjusting unit of claim 16, wherein the eyelets (47), in the strutlike printed circuit board part (352) of the printed circuit board (35), are located in one row, extending transversely to the longitudinal axis of the printed circuit board.

18. The adjusting unit of claim 16, further comprising at least one identically embodied second row of further eyelets (47'), made in the form of holes in the conductor tracks of the printed circuit board (35), is disposed, parallel to the first row of eyelets (47), in the strutlike printed circuit board part (352) of the printed circuit board (35).

19. The adjusting unit of claim 5, wherein the brush holder (21) comprises a hammer brush holder, which has at least two freely cantilevered, current-carrying leaf springs (40) each carrying one commutator brush (22) with spring prestressing oriented toward one another, and wherein the ends of the leaf springs (40) each contact one electrical conductor in the carrier plate (38).

20. The adjusting unit of claim 1, wherein the carrier plate (38) further comprises fastening holes (43) for receiving through fastening means fixing the carrier plate to the adjuster housing (13).

21. The adjusting unit of claim 10, wherein the carrier (30) forms a guide for a restoring device (26) engaging the final control element (11).

22. The adjusting unit of one claim 1, wherein the final control element (11) is a throttle valve (10) for controlling the inside cross section of an air intake sub (14) of the engine.

* * * * *